US006827013B2

(12) United States Patent
Richards

(10) Patent No.: US 6,827,013 B2
(45) Date of Patent: Dec. 7, 2004

(54) PRECOLLECT METHOD AND DEVICE

(75) Inventor: John Sheridan Richards, Barrington, NH (US)

(73) Assignee: Heidelberger Druckmaschinen AG, Heidelberg (DE)

( * ) Notice: Subject to any disclaimer, the term of this patent is extended or adjusted under 35 U.S.C. 154(b) by 23 days.

(21) Appl. No.: 10/015,957

(22) Filed: Dec. 13, 2001

(65) Prior Publication Data

US 2003/0110965 A1 Jun. 19, 2003

(51) Int. Cl.[7] ..... B41F 13/56; B41F 13/64; B65H 39/02; B65H 39/14

(52) U.S. Cl. ..... 101/227; 101/226; 270/18; 270/19; 270/52.07; 270/52.09

(58) Field of Search ..... 101/226, 227; 270/32, 41, 52.07, 52.09, 52.17, 6, 7, 9, 10, 11, 12, 13, 14, 15, 17, 18, 19; 83/934

(56) References Cited

U.S. PATENT DOCUMENTS 405,016 A * 6/1889 Crowell ..... 270/19
1,748,988 A * 3/1930 Morris ..... 270/48
1,909,518 A * 5/1933 Boyce ..... 270/11
1,968,630 A * 7/1934 Barber ..... 270/13
2,385,659 A * 9/1945 Tornberg ..... 270/11
2,600,284 A * 6/1952 Tranter ..... 270/52.13
4,015,837 A 4/1977 Ostler ..... 270/58
4,381,106 A * 4/1983 Loebach ..... 270/47
4,564,470 A * 1/1986 Schmitt ..... 270/21.1
5,527,256 A 6/1996 Vauchelle et al. ..... 493/424

* cited by examiner

*Primary Examiner*—Daniel J. Colilla
*Assistant Examiner*—Jill E. Culler
(74) *Attorney, Agent, or Firm*—Davidson, Davidson & Kappel, LLC

(57) ABSTRACT

A method and device for combining folios between a first and a second web in a rotary printing press. A first folio is cut from a third web in the rotary press, the first folio is stored on a storage device and then transferred from the storage device to a position between the first and second webs. Also, a web product moveable in a rotary printing press that includes a first web, a second web, a first folio, and a second folio. The first and second folios are stacked relative to one another and sandwiched between the first and second continuous webs.

14 Claims, 4 Drawing Sheets

PRECOLLECT METHOD AND DEVICE

BACKGROUND OF THE INVENTION

1. Field of the Invention

The present invention relates generally to a method and device for combining folios between a first and a second web in a rotary printing press and specifically to a method and device in which a third web in the press is cut into at least first and second folios, the folios are stored and positioned between the first and second webs. The present invention also relates to a web product having first and second folios in a stacked relationship to one another and sandwiched between two webs.

2. Background Information

In the technology of rotary printing presses using continuous webs of printed material it is often advantageous to collect the printed webs after they are folded in a former folder and cut, but before they are cross folded. This procedure, referred to as running collect, avoids the additional processing steps required in assembling products from straight production operations in which folios are not combined before folding.

It is not uncommon in rotary printing press applications for a print cylinder to print two images on a web per revolution. Using a straight running procedure, the web is then cut into folios so that each folio includes one full image. For example, if there are two images per print cylinder revolution, the length of the folio will be one half the circumference of the print cylinder. When running collect, the images thus printed and cut, may be "collected" in a manner that aligns respective images as required for the product. This collected product is then run together into a cross folder in which individual folios are folded simultaneously.

For example, when running collect using three webs, one revolution of the print cylinder may produce an image belonging to a first section of a printed product (such as a newspaper) directly adjacent to an image belonging to a second section of the printed product. By cutting and collecting the three webs together, they may be cross folded simultaneously to include two sections each having three folios. (For double-sided printing and only two printed newspaper pages per folio side, each section will include twelve pages). More or less webs can be added to include more or less folios per section. However, collect running always results in an equal number of folios in the two related sections. For a product having sections with an unequal number of pages per section (for example a newspaper having more folios in the front section than the second section), the product must be run using straight production with the sections combined as a later processing step.

SUMMARY OF THE INVENTION

The present invention provides a method for combining folios between a first and a second web in a rotary printing press. The method includes cutting a first folio from a third web in the rotary press, storing the first folio on a storage device, and transferring the first folio from the storage device to a position between the first and second webs.

The method may also include cutting a second folio from the third web and storing the second folio in a stacked relationship relative to the first folio from the third web on a precollect cylinder. The transferring step may include simultaneously transferring the stacked first and second folios from the precollect cylinder. The first, second, and third webs may be moved through the press at a same speed.

The method may include the additional steps of cutting a third folio from a fourth web and cutting a fourth folio from a fourth web. The storing step would then also include storing the third and fourth folios in a stacked relationship relative to one another and relative to the first and second folios on a precollect cylinder. The transferring step would then include simultaneously transferring the stacked first, second, third, and fourth folios from the precollect cylinder.

The precollect cylinder may have a circumference three, five, or seven times a length of the first folio which may be one-half a circumference of a print cylinder of the press.

An electrostatic charge may be provided to one or more of the first web, the second web, the first folio, and the second folio so as to enable an adhesion between the first and second folios and at least one of the first and second webs.

The present invention also provides a device for combining folios between first and second webs in a rotary printing press. The device includes a cutting cylinder configured to cut a first folio from a third web, a storing device in operative connection with the cutting cylinder configured store the first folio, and a positioning device adjacent the storing device. The positioning device is configured to transfer the stored first folio from the storing device to a position between the first and second webs. The cutting cylinder may be further configured to cut a second folio from the third web and the storing device may include a precollect cylinder configured to store the first and second folios in a stacked relationship. The positioning device may be configured to transfer the stacked first and second folios simultaneously. The precollect cylinder may have a circumference that is three times a length of the first folio, which may be equal to one-half a circumference of a print cylinder of the rotary printer. The print cylinder, in turn, may include a printing plate with at least two folio images arranged adjacent to one another so as to print to folios per cylinder revolution.

The precollect cylinder may include pins or grippers for holding the first and second folio against a circumference of the precollect cylinder.

The device according to the present invention may also include an electrode for providing an electrostatic charge to one or more of the first web, the second web and the folios so as to enable an adhesion between the first and second folios and at least one of the first and second webs. The positioning device may include a belt mounted on a plurality of belt rollers.

The present invention also provides a web product moveable in a rotary printing press. The web product includes a first web, a second web, a first folio, and a second folio. The first and second folios are stacked relative to one another and sandwiched between the first and second webs.

The web product may also include a third folio and a fourth folio, wherein the third and fourth folios are stacked relative to each other and relative to the first and second folios and sandwiched between the first and second webs.

BRIEF DESCRIPTION OF THE DRAWINGS

The present invention is elaborated upon below with reference to the accompanying drawings, in which.

DETAILED DESCRIPTION

Figure 1B:
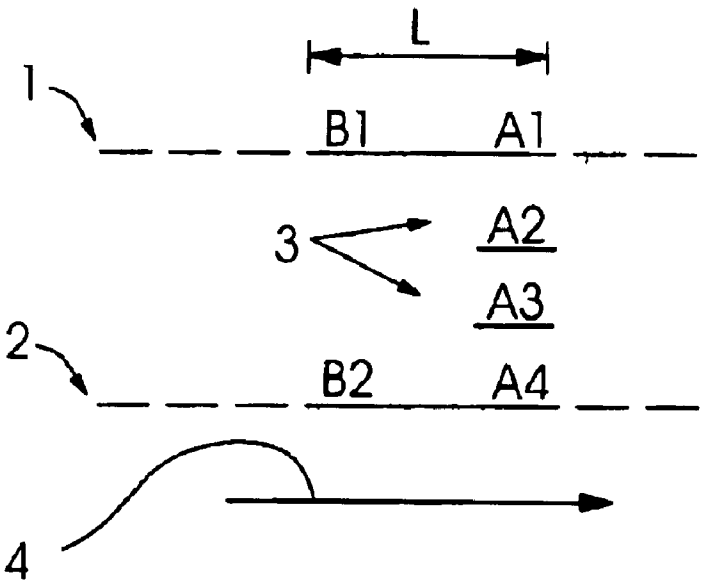
FIG. 1*b* shows a schematic diagram of a collect process in a press having three webs according to the present invention in which precollecting is used.
Figure 1A:
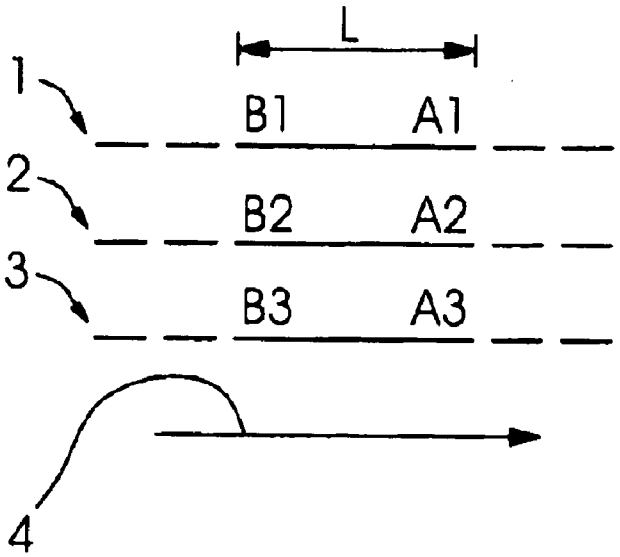
Fig.1a (PRIOR ART)
FIG. 1*a* shows a schematic diagram of a typical collect process in a press having three webs.

FIG. 1*a* shows a schematic diagram of three webs entering a former that have been arranged according to a typical web collect running process. Web 1 includes images B1 and A1, which together have a length equal to one revolution of a print cylinder. These images will be cut after the former to make folios B1 and A1. Folio A1 corresponds to the first folio of section A of a two-section printed product. Folio B1 corresponds to the first folio of section B of a two-section printed product. Similarly, web 3, which is running between webs 1 and 2 includes images A2 and B2, corresponding respectively to the second folio of sections A and B of the two-section printed product, and web 2 includes images A3 and B3, corresponding to the third folio of sections A and B of the two-section printed product. The webs have been arranged so that images A1, A2, and A3 are aligned with one another, as are images B1, B2, B3.

In the typical collect running process after the former, the webs will be simultaneously cut so that the resulting section A folios A1, A2, and A3 can be simultaneously processed with the resulting section B folios, resulting in a finished two-section printed product. For example, if each folio were to include two newspaper pages on each side, then the resulting two-section newspaper product would include twelve pages for each section. The number of pages per section in the printed product can only be varied by varying the number of webs that are combined prior to entering the former. In any case, using the typical collect running process will yield a result in which the two sections of the two-section printed product can only have an equal number of pages.

FIG. 1*b* shows a schematic diagram of two webs entering a former having folios cut from a third web sandwiched between them. As in FIG. 1*a*, web 1 includes images A1 and B1, corresponding to the first folios of sections A and B of a two-section product. Web 3, in FIG. 1*b* has been cut into two folios, and have been aligned to a stacked position between web 1 and web 2. Prior to being cut, web 2 included two adjacent images having a combined length equal to one print cylinder revolution. The two images correspond to folios A2 and A3, or the second and third images of section A of the two-section printed product. Web 2 includes two adjacent images A4 and B2, which correspond to the fourth folio of section A and the second folio of section B, respectively. The webs 1 and 2, and the folios A2 and A3 cut from web 3 are positioned with respect to one another so that so that images A1, A2, A3, and A4 are aligned with one another, as are images B1 and B2.

In the cross-folding process after the former, the webs 1 and 2 will be simultaneously cut so that the resulting section A folios A1, A2, A3, and A4 can be simultaneously processed with the resulting section B folios B1 and B2, resulting in a finished two-section printed product having four section A folios and two section B folios. Here, if each folio were to include two newspaper pages on each side, then the resulting two-section newspaper product would include sixteen pages in the first section and eight pages in the second section, a difference of eight pages.

The difference in the number of folios per section can be reduced to one folio if web 3 is run at a slower speed. The adjacent print images may then be the same images (A2 adjacent to A2), with each single A2 folio being cut and then accelerated to the speed of the additional webs 1 and 2, so that each A2 folio is placed in a position that aligns with the other A section folios of webs 1 and 2.

Of course the difference in the number of folios can also be increased by increasing the number of webs that are cut and precollected and inserted between the first and second webs. The total number of folios per section can also be increased by increasing the number of webs that are collected to sandwich the precollected folios.

Figure 2:
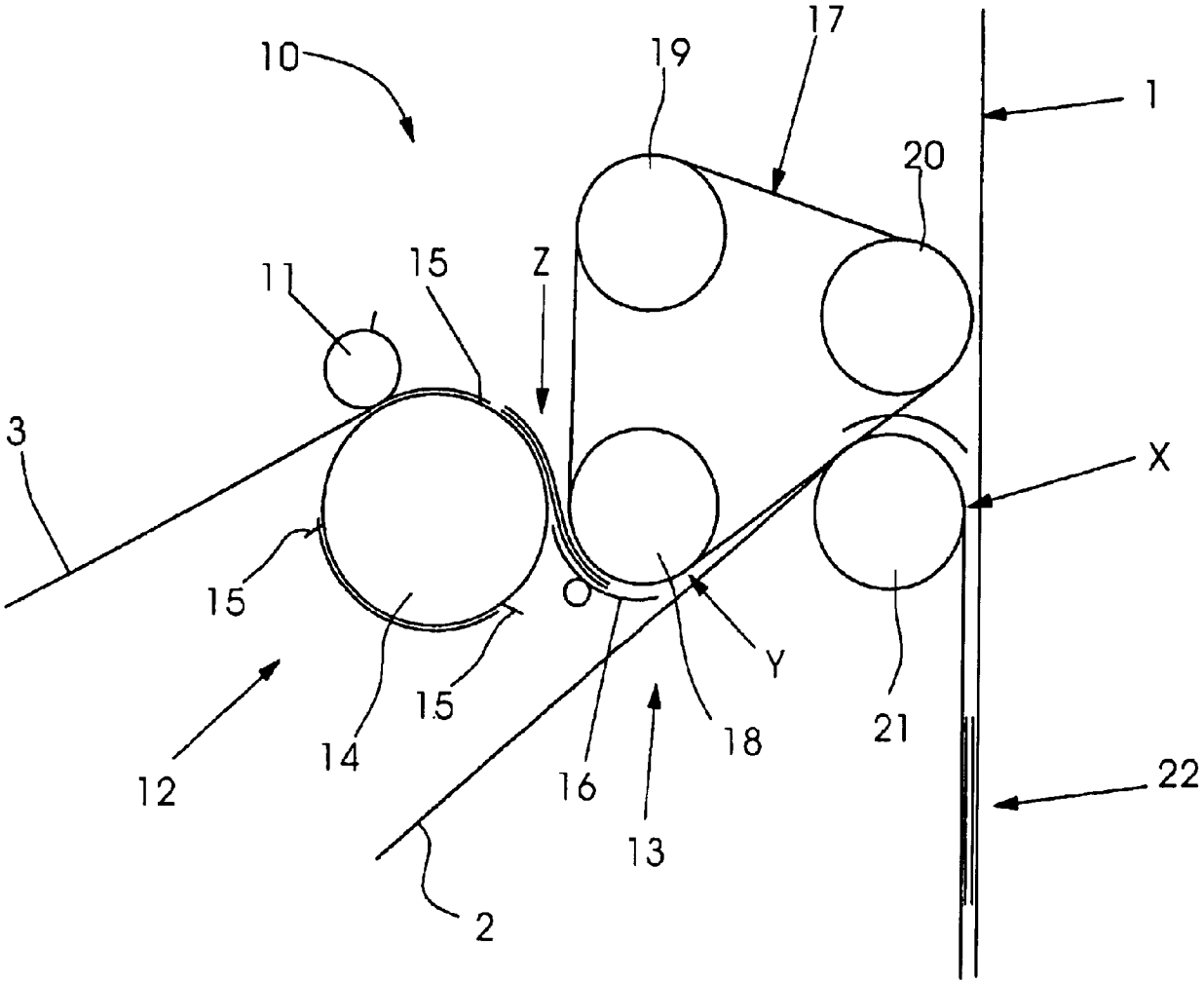
FIG. 2 shows a schematic side view of a device according to the present invention.

FIG. 2 shows a cross sectional view of one embodiment of a device 10 for combining folios between two webs according to the present invention. Web 3 is moving in a generally left-to-right direction across the drawing at a same speed as web 2 (carrying folio images B2, A4) and web 1 (carrying folio images B1, A1). Web 3 enters a nip between cutting cylinder 11 and storing device 12, which includes precollect cylinder 14. Precollect cylinder 14 moves in a clockwise direction and is in contact with cutting cylinder 11. Cutting cylinder 11 has a circumference that is one-half a circumference of a printing plate of the rotary press that printed images on web 3. In the embodiment from FIGS. 1*a* and *b*, the print cylinder was configured to print two folio images per revolution, and thus has a circumference equal to the combined lengths of two adjacent folio images. Cutting cylinder includes a cutting blade on its circumference for cutting the web, and therefore cuts one folio image per revolution into a folio. Precollect cylinder 14 has a circumference three times the circumference of the cutting cylinder 11.

Web 3 is cut by at the nip between cutting cylinder 11 and precollect cylinder 14 into separate folios. As a first folio is cut, corresponding to folio A3 from FIG. 1*a*, it is stored on precollect cylinder 14 of storage device 12. Pins 15 on the precollect cylinder assist holding the first folio to the circumference of precollect cylinder 14. The first folio A3 follows the path of the print cylinder to point z. At this point, if it is the lower folio, and it continues around the precollect cylinder 14 all the way until it reaches point z again. When it passes by the cutting cylinder again, a second folio corresponding to A2 is cut from the cutting cylinder 11 and placed on top of the first folio A3 in a stacked relationship on the circumference of precollect cylinder 14 with the aid of pins 15.

When the stacked pair of folios reaches point z again, the stacked first and second folios A3 and A2 are diverted from the precollect cylinder 14 by stripper 16 (part of positioning device 13). The pair of stacked folios A3 and A2 are married to web 2 at point y with the aid of belts 17 that are mounted around rollers 18, 19, and 20 and traveling at a same speed as web 2. The pair of folios A3 and A2 are aligned with folio image A4 on web 2. The pair of folios may again be pinned together with web 2, this time on the pin lead cylinder 21 where they are advanced to position x. At point x, the two folios and the web 2 are married with web 1 (containing folio images A1, B1) in alignment with folio image A1. After point x web product 22 includes the pair of folios A3 and A2 sandwiched between web 1 and web 2 so that stacked folios A3 and A2 align with folio image A1 on web 1 and folio image A4 on web 2.

Figure 4:
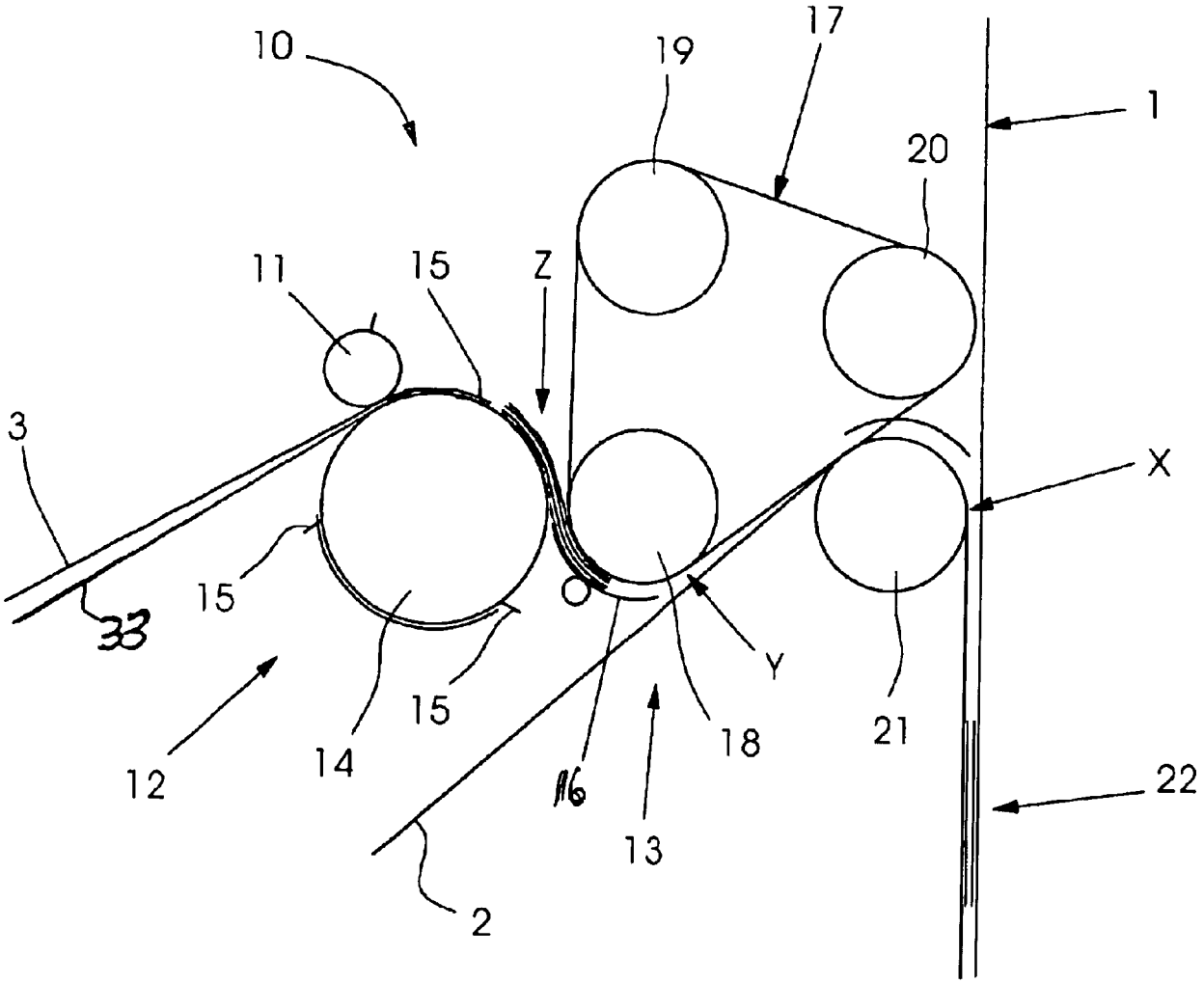
FIG. 4 shoes a schematic side view of a device according to the present invention with four webs.

FIG. 2 shows only one embodiment of the invention, yet there can be many variations within the scope of the invention. For example, several webs may be run together through the path of web 3, as shown by web 33 in FIG. 4. In this way several stacked pairs of folios may be precollected and inserted between webs 2 and 3. Of course there may be additional webs run together in addition to webs 1 and 2, and web product 22 may include more than the webs 1 and 2 that sandwich the folios between them. The positioning device may include an acceleration device instead of, or in addition to belts 17 running at constant speed. Web 2 may run at a slower speed, for example one-half the speed of webs 1 and 2, and the cut folios may be accelerated to the speed of webs 1 and 2 after being cut. In this way, the positioning device 13 positions one folio at a time between webs 1 and 2 as opposed to stacked folio pairs.

Electrostatic charge may be provided to one of the webs or folios in order to enable or improve adhesion between the folios and web 1 and/or web 2. Precollect cylinder 14 and pin lead cylinder 21 may be gripper cylinders instead of, or in addition to having pins.

Figure 3:
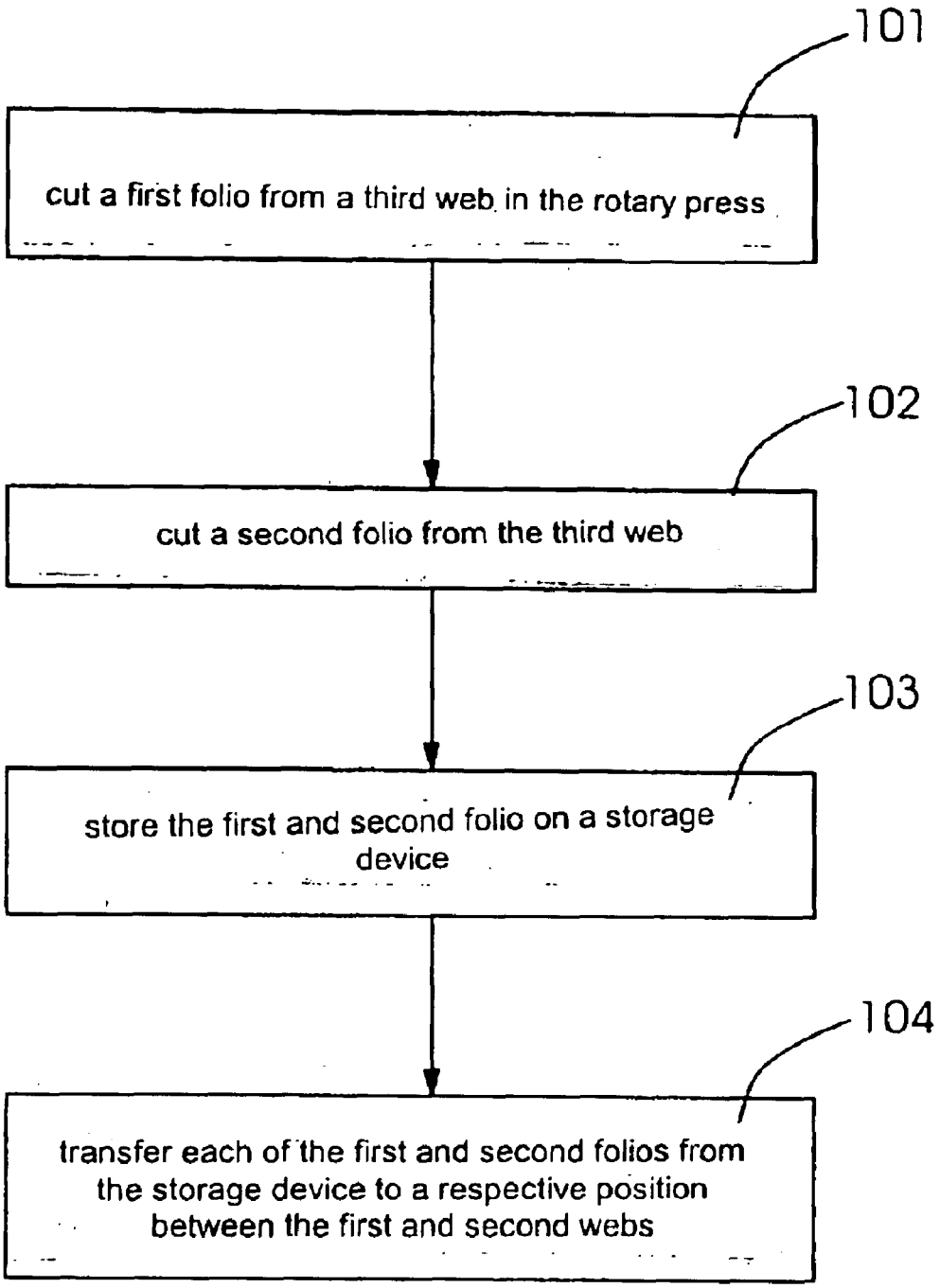
FIG. 3 is a schematic block diagram showing a method according to the present invention.

FIG. 3 shows a method for combining folios between a first and second web in a rotary press according to the present invention. In step 101, a first folio is cut from a third web in the rotary press. In step 102, a second folio is cut from the third web. The first and second folios are stored on a storage device in step 103. In step 104 the first and second folios are each transferred from the storage device to a respective position between the first and second webs.

It will of course be understood that the present invention has been described above only by way of example and that modifications of details can be made within the scope of the invention.

What is claimed is:

1. A method for combining folios between a first and a second web in a rotary printing press, the method comprising:

cutting a first folio from a third web in the rotary press;

storing the first folio on a storage device;

transferring the first folio from the storage device to a position between the first and second webs; and cutting a second folio from the third web;

the storing step including storing the second folio in a stacked relationship relative to the first folio on a precollect cylinder of the storing device;

the transferring step including simultaneously transferring the stacked first and second folios from the precollect cylinder to the position between the first and second webs.

2. The method as recited in claim 1 further comprising moving the first, second, and the third webs through the press at a same speed.

3. The method as recited in claim 1 further comprising:

cutting a third folio from a fourth web; and cutting a fourth folio from the fourth web, and wherein the storing step further includes storing the third and fourth folios in a stacked relationship relative to one another and relative to the first and second folios on the precollect cylinder, and wherein the transferring further includes simultaneously transferring the stacked first, second, third, and fourth folios from the precollect cylinder.

4. The method as recited in claim 1 wherein the precollect cylinder has a circumference three times a circumference of the first folio.

5. The method as recited in claim 1 wherein the cutting step is performed using a cutting cylinder having a circumference that is one-half a circumference of a print cylinder of the press.

6. The method as recited in claim 1 further comprising providing an electrostatic charge to at least one of the first web, the second web, the first folio, and the second folio so as to enable an adhesion between the first and second folios and at least one of the first and second webs.

7. A device for combining folios between first and second webs in a rotary printing press, the device comprising:

a cutting cylinder configured to cut a first folio and a second folio from a third web;

a storing device in operative connection with the cutting cylinder, the storing device including a precollect cylinder configured to transferer the stored first and second folios in a stacked relationship; and a positioning device adjacent the storing device configured to transfer the stored first folio and second folio from the storing device to a position between the first and second webs.

8. The device as recited in claim 7 wherein the positioning device is configured to transfer the stacked first and second folios simultaneously.

9. The device as recited in claim 7 wherein the precollect cylinder has a circumference that is equal to a length of one of three folios, five folios, and seven folios.

10. The device as recited in claim 7 wherein the first and second folios are printed from a printing plate of the printing press.

11. The device as recited in claim 7 wherein the precollect cylinder includes pins for holding the first and second folios against a circumference of the precollect cylinder.

12. The device as recited in claim 7 wherein the precollect cylinder includes grippers for holding the first and second folios against a circumference of the precollect cylinder.

13. The device as recited in claim 7 further comprising an electrode for providing an electrostatic charge to at least one of the first web, the second web and the first folio so as to enable an adhesion between the first folio and at least one of the first and second webs.

14. The device as recited in claim 7 wherein the positioning device includes a belt mounted on a plurality of belt rollers.

* * * * *